US008894046B2

(12) United States Patent
Lev

(10) Patent No.: US 8,894,046 B2
(45) Date of Patent: Nov. 25, 2014

(54) HUMIDIFIER HAVING AN ANTI-CONTAMINATION SYSTEM

(75) Inventor: Mordechai Lev, West Bloomfield, MI (US)

(73) Assignee: FKA Distributing Co., LLC, Commerce Township, MI (US)

( * ) Notice: Subject to any disclaimer, the term of this patent is extended or adjusted under 35 U.S.C. 154(b) by 279 days.

(21) Appl. No.: 13/555,021

(22) Filed: Jul. 20, 2012

(65) Prior Publication Data

US 2013/0154134 A1 Jun. 20, 2013

Related U.S. Application Data

(60) Provisional application No. 61/509,778, filed on Jul. 20, 2011.

(51) Int. Cl.
*B01F 3/04* (2006.01)
*F24F 6/12* (2006.01)
*F24F 3/16* (2006.01)

(52) U.S. Cl.
CPC ..... *F24F 6/12* (2013.01); *F24F 2003/1667* (2013.01)
USPC ..... 261/78.2; 261/81; 261/119.1

(58) Field of Classification Search
USPC ..... 261/78.2, 81, 119.1
See application file for complete search history.

(56) References Cited

U.S. PATENT DOCUMENTS 4,630,475 A 12/1986 Mizoguchi
4,686,069 A 8/1987 Hahne et al.
4,714,078 A 12/1987 Paluch
4,810,854 A 3/1989 Jursich et al.
4,899,057 A 2/1990 Koji
4,993,411 A * 2/1991 Callaway ..... 128/204.14
5,273,689 A 12/1993 Hamasaki
5,366,705 A 11/1994 Reidy
5,677,982 A 10/1997 Levine et al.
5,859,952 A 1/1999 Levine et al.
5,915,161 A 6/1999 Adams
2010/0133707 A1 * 6/2010 Huang ..... 261/81

FOREIGN PATENT DOCUMENTS

JP S61138928 U 8/1986
JP 63306337 A 12/1988
JP 63306340 A 12/1988
JP H1107032 A 4/1989

* cited by examiner

*Primary Examiner* — Robert A Hopkins
(74) *Attorney, Agent, or Firm* — Brooks Kushman P.C.

(57) ABSTRACT

A humidifier is provided having a base including a chamber for receiving water, at least one reservoir removably mounted on the base for providing water to the base chamber, and an atomizer provided in the base for aerosolizing water from the base chamber. A duct is removably mounted on the base, the duct enclosing the atomizer and venting humidified air from the humidifier. An anti-contamination system is in communication with the duct and includes a housing, an ultraviolet (UV) light source mounted within the housing for emitting UV light to interact with at least one of the aerosolized water and humidified air, and a window at least partially transparent to UV light provided between the anti-contamination system and the duct. Embodiments may include a reflective member provided within the housing for reflecting UV light through the window.

30 Claims, 8 Drawing Sheets

HUMIDIFIER HAVING AN ANTI-CONTAMINATION SYSTEM

CROSS-REFERENCE TO RELATED APPLICATIONS

This application claims the benefit of U.S. provisional Application No. 61/509,778 filed Jul. 20, 2011, the disclosure of which is incorporated in its entirety by reference herein.

TECHNICAL FIELD

Various embodiments relate to humidifiers having a sterilization or anti-contamination system.

BACKGROUND

Humidifiers are used to condition the air. For example, a humidifier may be used in a residential or commercial environment to increase the moisture in the air for comfort or other purposes. When an indoor environment is heated, it often needs to be humidified to provide an improved comfort level. Humidifiers may be portable such that they can be easily moved or used in a location without a built-in humidifier. Portable humidifiers have water reservoirs and water flow passages, which may become contaminated with microorganisms living in the water. The contaminated water in the humidifier has the potential to produce contaminated humidified air or contaminated aerosolized water.

BRIEF DESCRIPTION OF THE DRAWINGS

FIG. 3 also illustrates the lower surface of a reservoir tank;

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
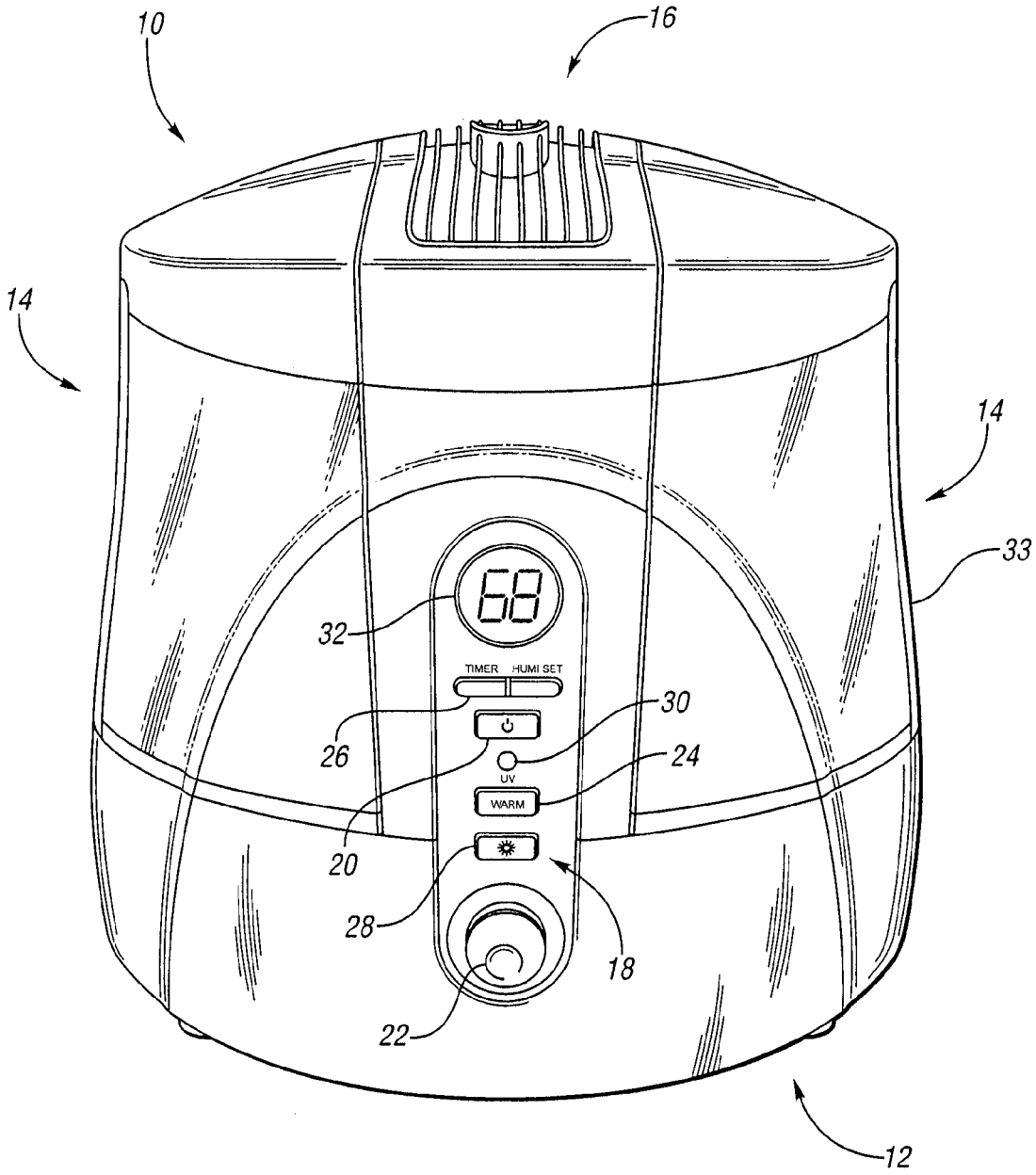
FIG. 1 is a perspective view of a humidifier according to an embodiment.

FIG. 1 illustrates a humidifier 10 having an anti-contamination system according to an embodiment. The humidifier 10 has a base 12, a pair of water reservoirs 14, and a duct 16. The pair of water reservoirs 14 acts as holding tanks for the water to be used with the humidifier 10. Although two water reservoirs 14 are shown, any number of reservoirs is contemplated for use with the invention. Water flows from the reservoirs 14 through the base 12 where it may or may not be heated and is aerosolized. The aerosolized water, or humidified air, then flows from the base 12 through the duct 16, which contains an anti-contamination system. The decontaminated humidified air then exits the duct 16 and exits the humidifier 10 to the environment.

The base 12 contains various user controls 18, which may include a power button 20, a humidity control dial 22, a heat control button 24, a timer 26 for the humidifier 10, a reservoir backlight 28, an anti-contamination system indicator light 30, and a display 32 to display information for a user.

Figure 2:
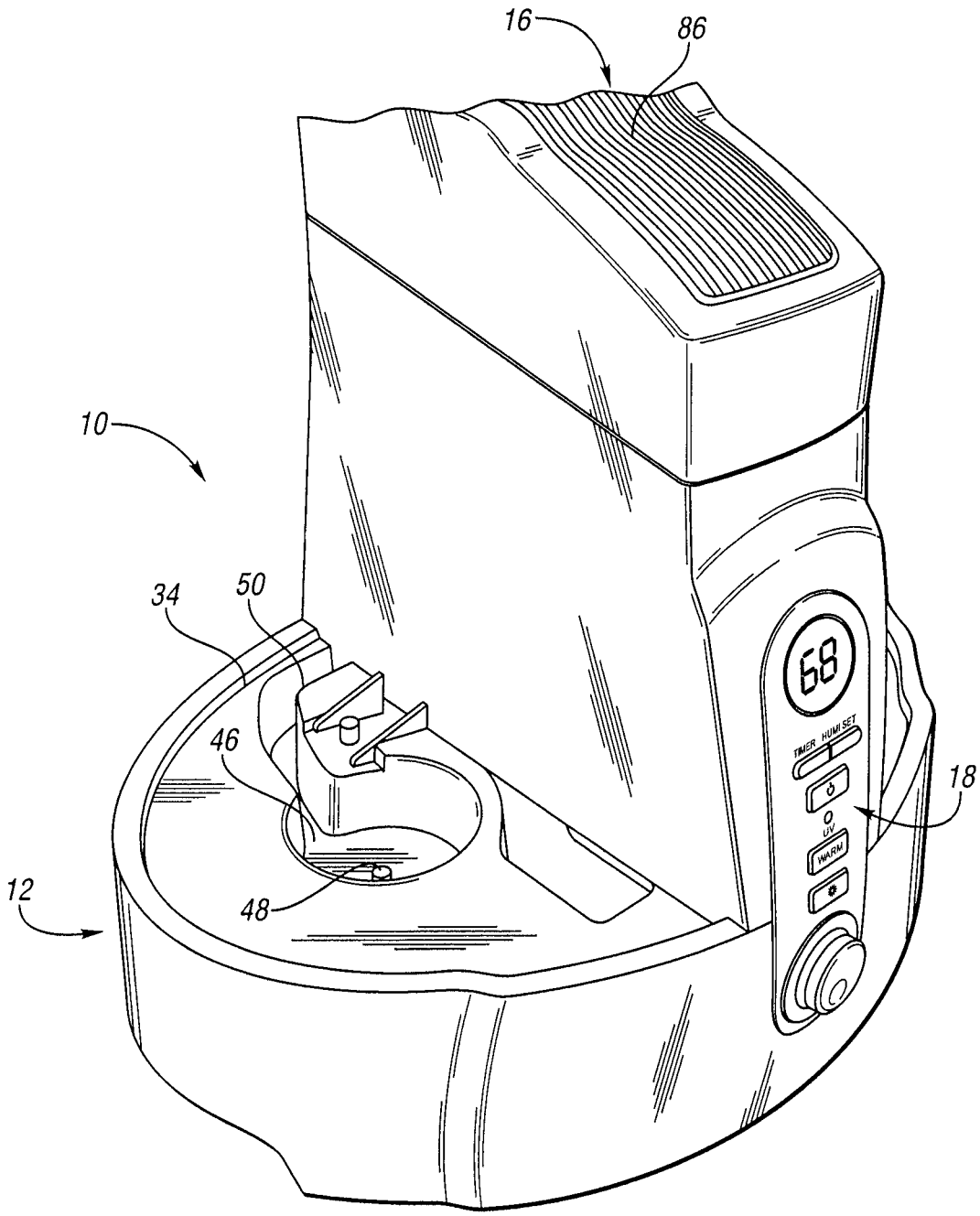
FIG. 2 is a perspective view of the humidifier of FIG. 1 shown with the reservoir tanks removed.
Figure 3:
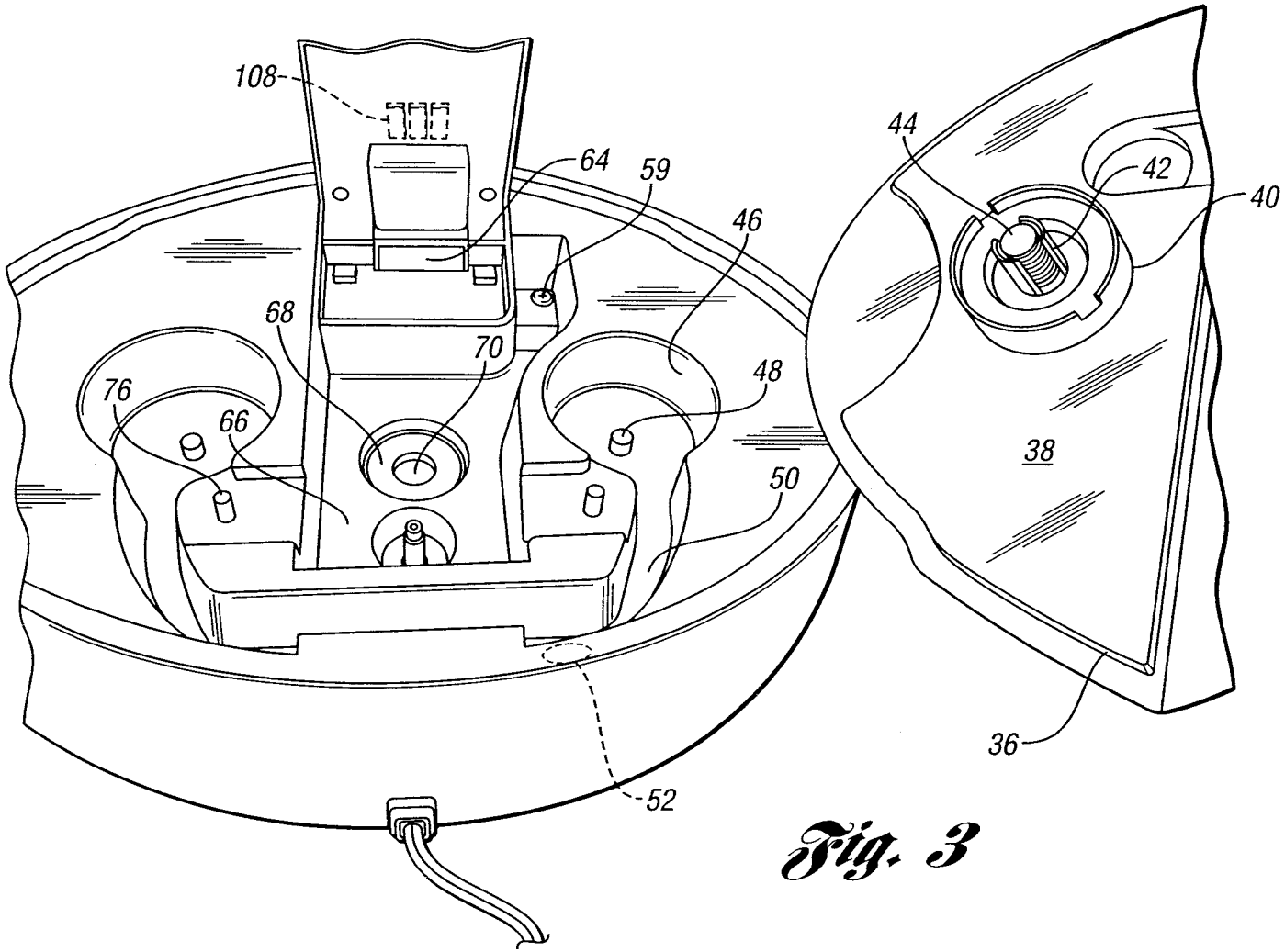
FIG. 3 is a perspective view of the humidifier of FIG. 1 shown with the reservoir tanks and the duct removed.

FIG. 2 illustrates the humidifier 10 having the reservoirs 14 removed from the base 12, while FIG. 3 illustrates a humidifier 10 having the reservoirs 14 and the duct 16 removed from the base. The reservoirs 14 are removable such that they may be refilled with water and be cleaned. The duct 16 is removable for cleaning, and also so that the base 12 may be cleaned by a user. The reservoirs 14 each have a handle 33 to aid in carrying the reservoirs 14.

Referring to FIGS. 2 and 3, the base 12 has a step 34 which mates with a step 36 on the bottom surface 38 of the reservoir 14 to retain the reservoir 14 on the base 12. Locator pins or another mechanism may be also or alternatively used to position the reservoir 14 in place. The reservoir 14 has a cylindrical collar 40 located on the bottom surface 38 of the reservoir 14. The collar 40 is removable from the reservoir 14, such as by a threaded fitting, to allow the reservoir 14 to be refilled with water by a user and to allow access for cleaning. Alternatively, the collar 40 may be located on another location of the reservoir 14. The collar 40 may also be connected to the reservoir 14 by another mechanism, and may include an o-ring or other seal to help retain the water. The collar 40, as shown in FIG. 3, contains a valve 42. The valve 42 has a seat which is activated with a spring-loaded member 44. The spring-loaded member 44 biases the valve 42 closed when it is not actuated, such that the seat is sealed against the collar 40 and water cannot flow through. When the spring-loaded member 44 is actuated and compressed when positioned on the base 12, the valve 42 is opened allowing water to pass through. The humidifier 10 is gravity fed, as the reservoir water level is higher than the various fluid connections in the base 12.

The base 12, as shown in FIGS. 2 and 3, defines a chamber 46 which has a stem 48 protruding upwards from it. The chamber 46 is sized to receive the collar 40 on the reservoir 14. The stem 48 is positioned to engage the spring-loaded member 44 of the valve 42, thereby opening the valve 42. When the reservoir 14 is positioned on the base 12, the stem 48 engages the spring-loaded member 44, thereby opening valve 42 and allowing water to flow from the reservoir 14 and into the chamber 46. The water then flows from chamber 46, through passage 50 in the base 12, and down passage 52 through the base 12 surface.

Figure 5:
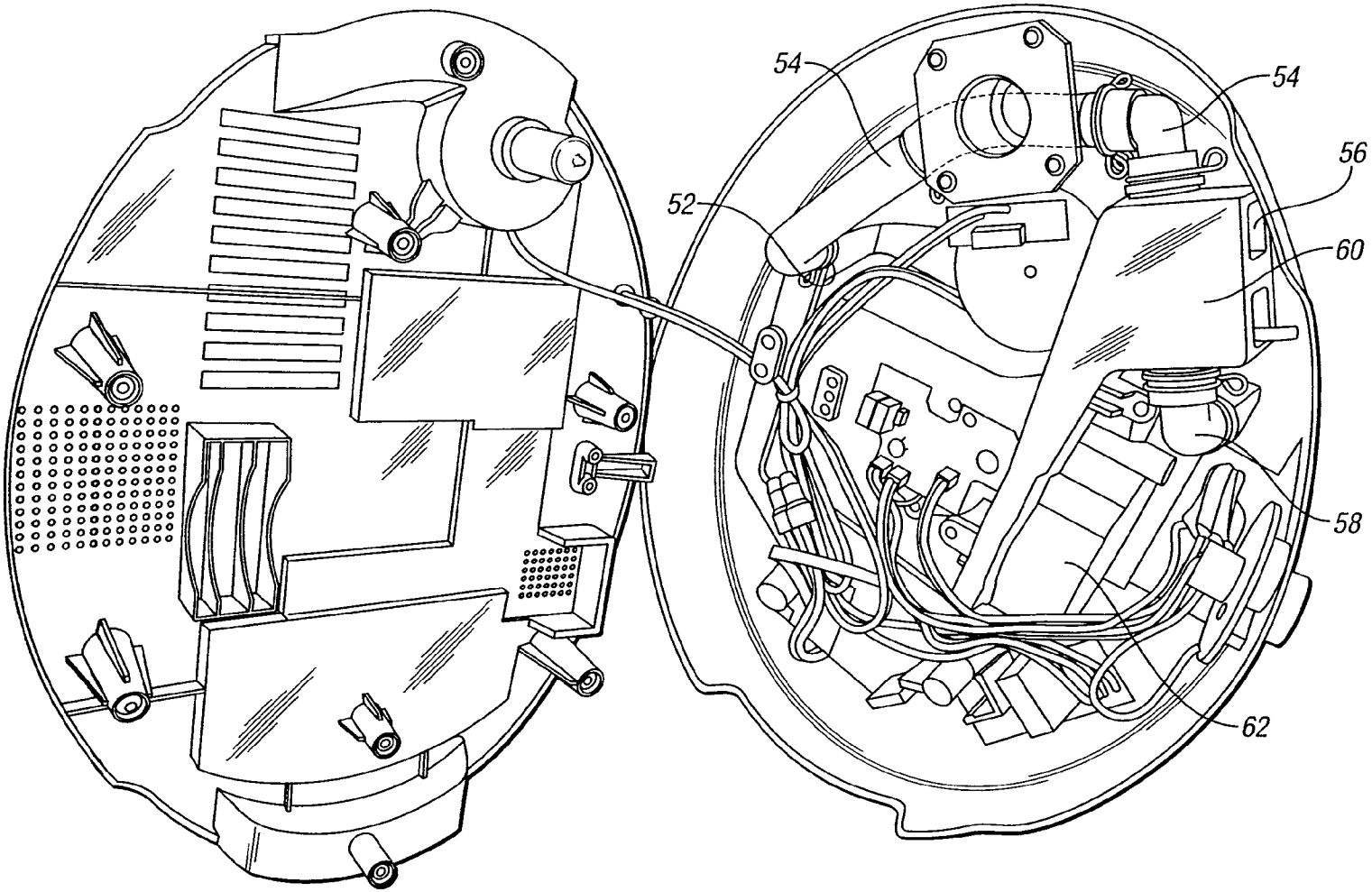
FIG. 5 is a partially disassembled perspective view of the base unit of the humidifier of FIG. 1.

Referring now to FIG. 5, the base 12 is shown in a partially disassembled view. The passage 52 takes the water from passage 50 on the upper surface of the base 12 and directs the water into tubing 54, which in turn is connected to a heating unit 56. The heating unit 56 may be a resistive heater, such as with resistive heating tape around a conductive pipe, or any other heater as is known in the art. If the unit is being used as a warm mist humidifier 10, the heater is turned on. If the unit is being used as a cool mist humidifier 10, the heater is turned off, or alternatively may not be present in the unit.

The heating unit 56 is covered by a housing 60. The housing 60 acts as the inlet manifold for a fan 62 and draws ambient air over the heating unit 56. The fan 62 then exhausts the warm air through port 64, shown in FIG. 3. The housing 60 over the heating unit 56 serves to pull air over the heating unit 56 providing for cooling of the heating unit 56 in addition to warming the air exiting port 64, which may provide for improved humidifier efficiencies and increased entrainment of water content in the air leaving the humidifier 10.

The heating unit 56 may be controlled by the heat setting button 24, located at user controls 18 (FIG. 1), where a user selects whether the humidifier is operating in a cool or warm mist setting. If the humidifier 10 is being used as a cool mist unit, the fan 62 still draws air through the housing 60 and out through port 64, however the air in this case is not heated since the heating unit 56 is off.

After leaving the heating unit 56, the water continues through tubing 58, which is connected to a passage 59, which in turn leads to a basin 66, as shown in FIG. 3. The basin 66 has a recessed area 68, which contains an ultrasonic atomizer 70. The water pools in basin 66 and is aerosolized by the atomizer 70. Although an ultrasonic atomizer 70 is shown for use with the humidifier 10, any other mechanism for atomizing, aerosolizing, or evaporating water is contemplated.

Figure 4:
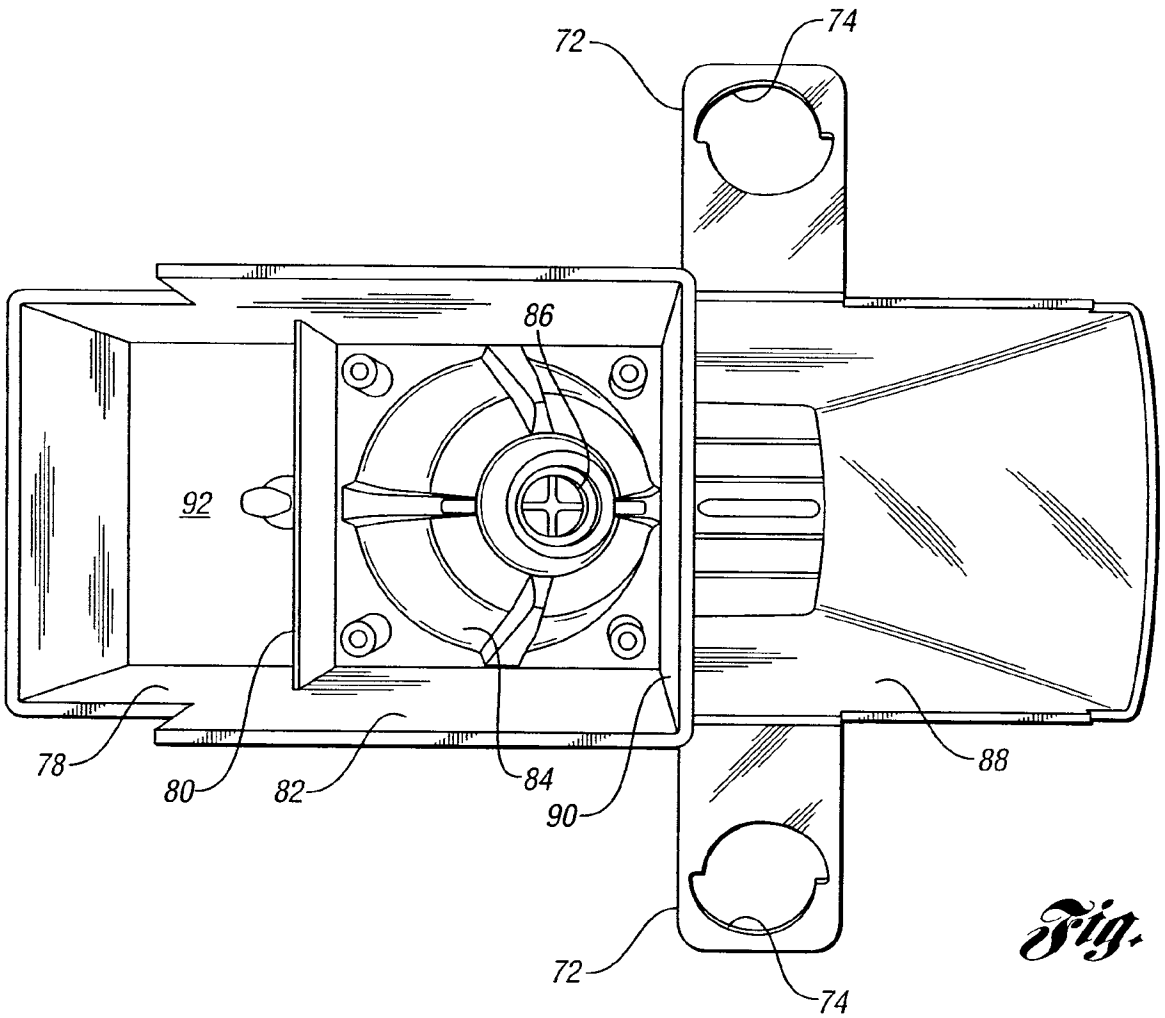
FIG. 4 is a bottom perspective view of the duct used with the reservoir of FIG. 1.

As shown in FIGS. 4 and 5, the duct 16 is positioned on the base 12 using a pair of brackets 72 which have apertures 74 that cooperate with locating pins 76 in recesses on the base 12. The duct 16 may have multiple internal chambers and baffles. In one embodiment, the air from the fan 62 exits port 64 in the base 12 and flows into in the first chamber 78 of the duct 16, when the duct is connected to the base 12. The air then flows underneath the first baffle 80, which directs the air into the second chamber 82 of the duct 16.

The ultrasonic atomizer 70 is located on the base 12 and positioned beneath the second chamber 82 of the duct 16. The atomizer 70 serves to aerosolize the water in the basin 66, which is then entrained by the passing air in the second chamber 82. The water-laden air then vents from the second chamber 82 up through chimney 84 to the top of the duct 16. A plurality of vents 86 (best shown in FIG. 2) are located at the top of the duct 16, which in some embodiments may direct the humidified air.

A third chamber 88 may also be located inside the duct 16 and is separated from the second chamber 82 by a second baffle 90.

Figure 6:
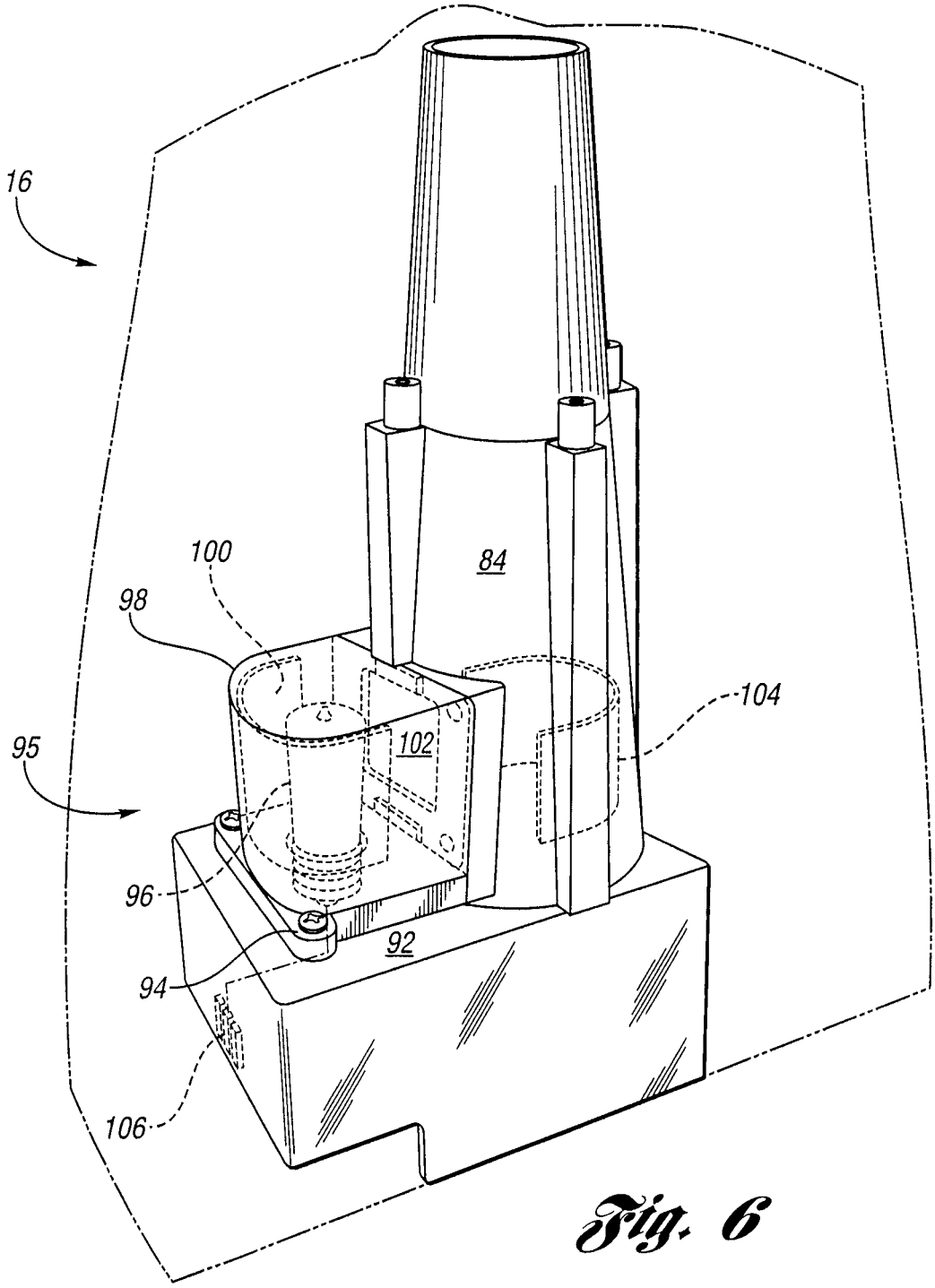
FIG. 6 is a perspective view of a duct having an anti-contamination unit according to an embodiment.

In some embodiments, such as depicted in FIG. 6, a floor 92 may be located in either the first chamber 78 or the third chamber 88 of the duct 16. The floor 92 supports a mounting plate 94 for an anti-contamination system 95. The anti-contamination system 95 is positioned to treat the water after it has been aerosolized and/or evaporated into the air. The anti-contamination system 95 acts to reduce microorganisms such as bacteria, mold, and the like from the water.

The anti-contamination system 95 may be an ultraviolet (UV) light source such as a UV bulb 96, or the like. In some embodiments, the UV bulb 96 is at least partially surrounded by a housing 98. The housing 98 may include a reflective member, such as reflective tape, a reflective coating 100, or the like, which reflects or partially reflects the light emitted from the UV bulb 96. The reflective coating 100 has optical properties where it is at least partially reflective to light in the ultraviolet range, and may be integral with the housing 98 or disposed within the housing 98.

The UV bulb 96 emits ultraviolet light, or electromagnetic radiation, having a wavelength at least partially in the ultraviolet (UV) range. Ultraviolet light is typically within a wavelength range of 10 to 400 nanometers. The bulb 96 may also emit light in additional wavelengths to those in the ultraviolet range. The bulb 96 may emit over a broadband spectrum, a range in the spectrum, or be tuned or have a coating such that it emits light in one or more tuned wavelength bands.

Figure 8:
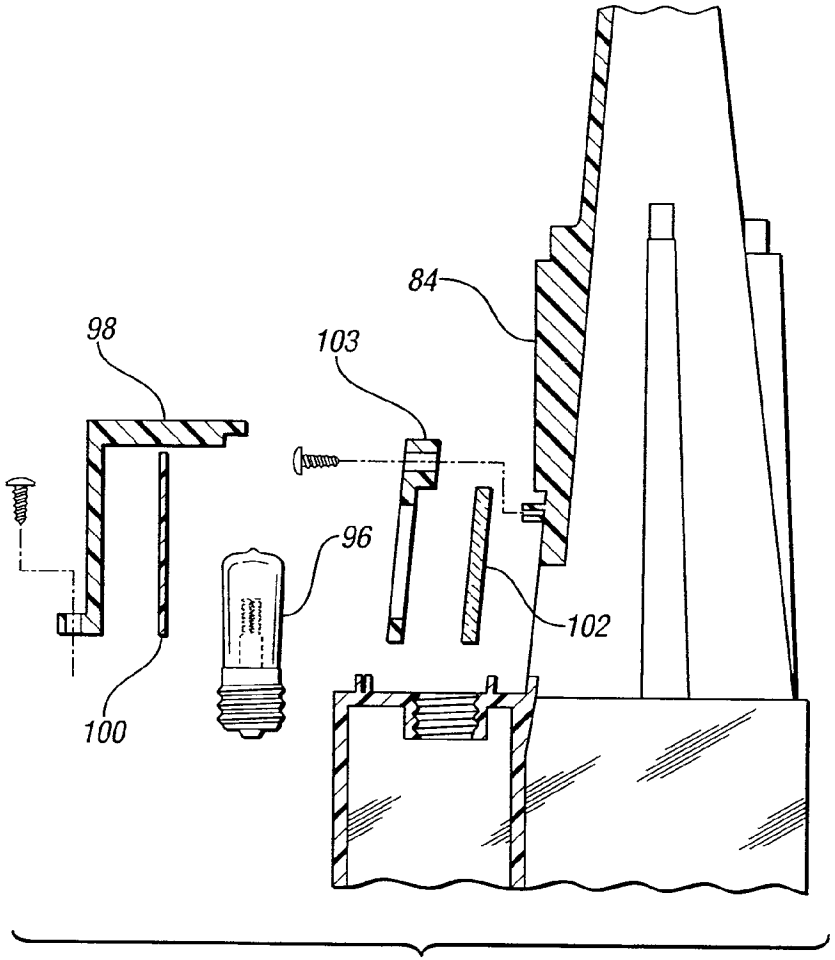
FIG. 8 is an exploded view of the anti-contamination system as shown in FIG. 6.
Figure 7:
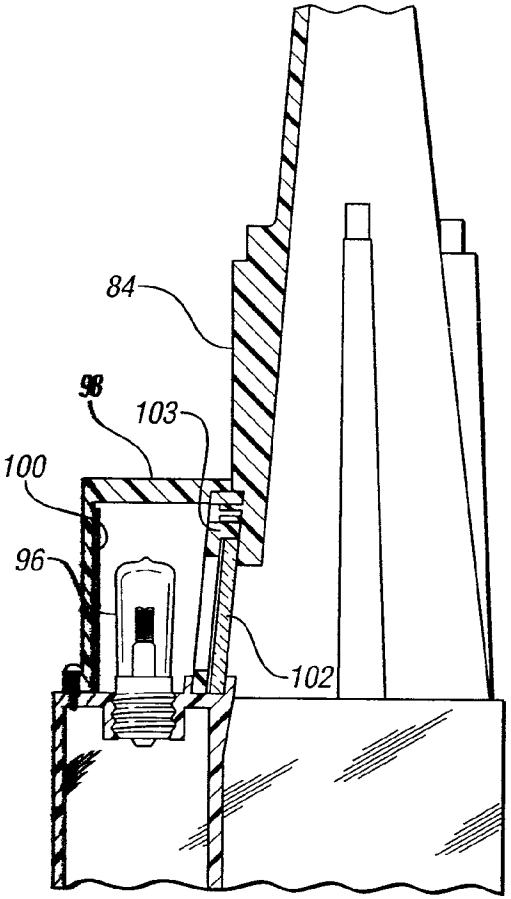
FIG. 7 is a side schematic view of the anti-contamination system as shown in FIG. 6.

With reference to FIGS. 6-8, the light emitted from the bulb 96 is directed from the bulb 96 through a window 102, or is directed from the bulb 96 and reflected by the tape 100 and through the window 102. The window 102 is made from a material that is transparent or partially transparent to ultraviolet light. In one embodiment, the window 102 is made from a quartz material, although other materials having the appropriate optical characteristics are also contemplated. In one embodiment, the window 102 is mounted to the chimney 84 of the second chamber 82 using a window frame 103 (FIG. 7), and supports may also be provided within the chimney 84 to locate the window 102.

The chimney 84 may also have a reflective member such as reflective coating 104, or other reflectors, adjacent to the window 102 to provide for multi-passing the UV light through the treatment area in the chimney 84 for the aerosolized water.

The window 102 is located in the chimney 84 such that the UV light interacts with the aerosolized water in the chimney 84. The window 102 prevents moisture from reaching the bulb 96 and provides a consistent flow path with the chimney 84 for the humidified air and aerosolized water. The aerosolized water and humidified air is treated by the UV light in the chimney 84 as it flows past the window 102. Since the water has been aerosolized, it has a high surface area and a small volume in the individual aerosol droplets, which provides for a lower residence time needed for treatment by the UV light in order to decontaminate the water. Since the aerosolized droplets of water are relatively small, e.g., on the order of tens or hundreds of microns in size, the time needed by the UV light to decontaminate new droplets is reduced due to their increased surface area and smaller volume than water in a bulk liquid phase.

Ultraviolet light may destroy living microorganisms and breakdown other organic material found in air and in the aerosolized water. The decontamination occurs in the chimney 84 of the humidifier 10, which is a downstream location within the humidifier 10, and therefore prevents further contamination of the water within the humidifier 10.

The chimney 84 may contain reflectors, or louvers, or the like to prevent or limit the UV light exiting the chimney 84 at the vent location 86 of the duct 16.

The bulb 96 requires electrical power, which is provided by an electrical connection 106 as depicted in FIG. 6. In order for the duct 16 to be removable, the electrical connection 106 can easily be disconnected and reconnected. In one embodiment, the electrical connection 106 is a series of contacts which mate with corresponding electrical connections 108, as shown in FIG. 3, which transfer electrical current when in contact with one another from a wall outlet or other power source and to the bulb 96.

Figure 9:
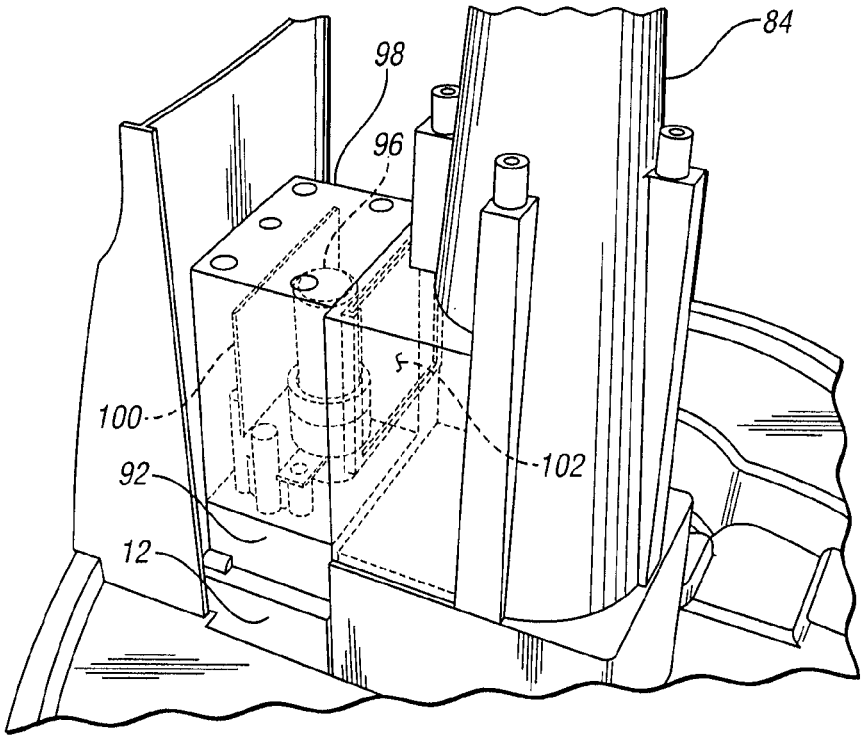
FIG. 9 is a partially disassembled perspective view of the base, anti-contamination system, and duct chimney according to an embodiment.
Figure 10:
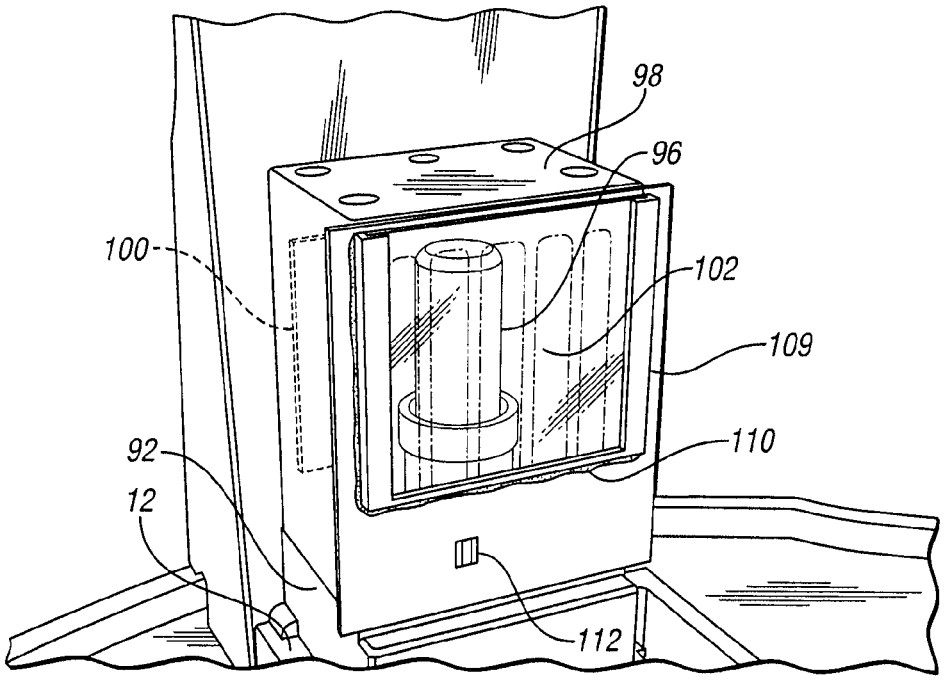
FIG. 10 is a partially disassembled perspective view of the base and anti-contamination system according to an embodiment.

In other embodiments of the anti-contamination system 95, such as depicted in FIGS. 9 and 10, the system 95 may be mounted to the base 12 of the humidifier 10 instead of being attached to the duct 16. The floor 92 is connected to the base 12 and supports a UV bulb 96. The reflective member 100 is placed within a housing 98 connected to the floor 92 or directly to the base structure 12. A window 102 is connected to the housing 98 to enclose the bulb 96, such as via sliding or otherwise fitting into a frame 109, and the chimney 84 has an aperture to allow UV light to pass through the window 102 and the aperture and into the interior of the chimney 84. Alternatively, the window 102 may be designed into the chimney 84 of the duct 16 such that the window 102 and the housing 98 cooperate to enclose the bulb 96 when the duct 16 is installed on the base 12. A seal 110 or the like may be located between the anti-contamination unit 95 on the base 12 and the duct 16 to encase the unit 95 and prevent light from exiting to the environment. A safety switch 112 may be included with the unit 95, such that the UV bulb 96 can only be powered when the duct 16 is installed onto the base 12 to prevent the bulb 96 from operating and emitting light to the surrounding environment.

The indicator light 30 indicates to the user when the UV bulb 96 is operating and decontaminating the aerosolized water. The humidity control 22 acts as a metering device to change the amount of aerosolized water by, for example, controlling the ultrasonic atomizer 70 to various frequencies. The heating function provided by the heating unit 56 acts to heat the water before it reaches the basin 66 and the atomizer 70, as well as heating the air before it goes through the fan 62 and the port 64. By heating the air and the water, the humidity content of the humidified air may be increased by providing for additional evaporation of the water into the air.

Other embodiments of a humidifier 10 may include an alternative method of aerosolizing the water or entraining the water into the air stream. For example, a spray nozzle, a pass over system, a bubbling system, or an evaporative humidifier, such as one that uses a wick or a vaporizer to vaporize the water into the passing air, may be utilized.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A humidifier, comprising:

a base including a chamber for receiving water;

at least one reservoir removably mounted on the base for providing water to the base chamber;

an atomizer provided in the base for aerosolizing water from the base chamber;

a duct removably mounted on the base, the duct including a first chamber and a second chamber, the first and second chambers separated by a baffle that prevents fluid communication therebetween, the second chamber enclosing the atomizer and venting humidified air from the humidifier, the second chamber including an aperture; and an anti-contamination system mounted to the base and arranged to be received within the duct first chamber, the anti-contamination system including a housing, an ultraviolet (UV) light source mounted within the housing for emitting UV light to interact with at least one of the aerosolized water and humidified air, and a window at least partially transparent to UV light mounted in the housing, wherein the window is aligned with the aperture to provide UV light to the second chamber.

2. The humidifier of claim 1, wherein the housing includes a reflective member for reflecting UV light through the window.

3. The humidifier of claim 1, wherein the second chamber includes a reflective member adjacent to the window to at least partially reflect light emitted from the UV light source.

4. The humidifier of claim 1, wherein the base includes a heating unit for heating water in the base.

5. The humidifier of claim 1, further comprising a fan disposed in the base for providing air to the duct, wherein the aerosolized water is entrained in the air to create humidified air.

6. The humidifier of claim 1, wherein the reservoir includes a collar removably mounted on a bottom surface of the reservoir, the collar including a valve actuated when the reservoir is positioned on the base to release water into the base chamber.

7. The humidifier of claim 1, further comprising a seal between the anti-contamination system and the second chamber.

8. The humidifier of claim 1, wherein the anti-contamination system includes a safety switch such that power to the UV light source is disabled when the duct is removed from the base.

9. A humidifier, comprising:

a base including a chamber for receiving water;

at least one reservoir removably mounted on the base for providing water to the base chamber;

an atomizer provided in the base for aerosolizing water from the base chamber;

a duct removably mounted on the base, the duct having a chamber enclosing the atomizer and venting humidified air from the humidifier; and an anti-contamination system external to the chamber such that fluid communication with the chamber is prevented and including a housing, an ultraviolet (UV) light source mounted within the housing for emitting UV light to interact with at least one of the aerosolized water and humidified air, a window at least partially transparent to UV light provided between the anti-contamination system and the duct, and a reflective member provided within the housing for reflecting UV light through the window.

10. The humidifier of claim 9, wherein the duct includes a reflective member adjacent to the window to at least partially reflect light emitted from the UV light source.

11. The humidifier of claim 9, wherein the anti-contamination system is mounted to the base.

12. The humidifier of claim 9, wherein the anti-contamination system is mounted within the duct.

13. The humidifier of claim 12, wherein the duct includes a first chamber including the anti-contamination system.

14. The humidifier of claim 9, wherein the window is mounted to the duct.

15. The humidifier of claim 9, wherein the window is mounted in the anti-contamination system.

16. The humidifier of claim 9, further comprising electrical connections on the duct configured to mate with corresponding electrical connections on the base to provide power to the UV light source.

17. The humidifier of claim 9, wherein the base includes a heating unit for heating water in the base.

18. The humidifier of claim 9, further comprising a fan disposed in the base for providing air to the duct, wherein the aerosolized water is entrained in the air to create humidified air.

19. The humidifier of claim 9, wherein the reservoir includes a collar removably mounted on a bottom surface of the reservoir, the collar including a valve actuated when the reservoir is positioned on the base to release water into the base chamber.

20. A humidifier, comprising:

a base including a chamber for receiving water;

at least one reservoir removably mounted on the base for providing water to the base chamber, the reservoir including a collar removably mounted on a bottom surface of the reservoir, the collar including a valve actuated when the reservoir is positioned on the base to release water into the base chamber;

an atomizer provided in the base for aerosolizing water from the base chamber;

a duct removably mounted on the base, the duct having a chamber enclosing the atomizer and venting humidified air from the humidifier; and an anti-contamination system external to the chamber such that fluid communication with the chamber is prevented and including a housing, an ultraviolet (UV) light source mounted within the housing for emitting UV light to interact with at least one of the aerosolized water and humidified air, and a window at least partially transparent to UV light provided between the anti-contamination system and the duct.

21. The humidifier of claim 20, wherein the housing includes a reflective member for reflecting UV light through the window.

22. The humidifier of claim 20, wherein the duct includes a reflective member adjacent to the window to at least partially reflect light emitted from the UV light source.

23. The humidifier of claim 20, wherein the anti-contamination system is mounted to the base.

24. The humidifier of claim 20, wherein the anti-contamination system is mounted within the duct.

25. The humidifier of claim 24, wherein the duct includes a first chamber including the anti-contamination system.

26. The humidifier of claim 20, wherein the window is mounted to the duct.

27. The humidifier of claim 20, wherein the window is mounted in the anti-contamination system.

28. The humidifier of claim 20, further comprising electrical contacts on the duct configured to mate with corresponding electrical connections on the base to provide power to the UV light source.

29. The humidifier of claim 20, wherein the base includes a heating unit for heating water in the base.

30. The humidifier of claim 20, further comprising a fan disposed in the base for providing air to the duct, wherein the aerosolized water is entrained in the air to create humidified air.

* * * * *